US005546500A

United States Patent [19]

Lyberg

[11] Patent Number: 5,546,500

[45] Date of Patent: Aug. 13, 1996

[54] ARRANGEMENT FOR INCREASING THE COMPREHENSION OF SPEECH WHEN TRANSLATING SPEECH FROM A FIRST LANGUAGE TO A SECOND LANGUAGE

[75] Inventor: Bertil Lyberg, Vagnhärad, Sweden

[73] Assignee: Telia AB, Farsta, Sweden

[21] Appl. No.: 238,732

[22] Filed: May 5, 1994

[30] Foreign Application Priority Data

May 10, 1993 [SE] Sweden ..... 9301596

[51] Int. Cl.[6] ..... G10L 3/00

[52] U.S. Cl. ..... 395/2.86; 395/2.44; 395/2.69; 395/2.77

[58] Field of Search ..... 395/2.29, 2.4, 395/2.44, 2.6, 2.67, 2.69, 2.86, 2.77; 381/36, 43, 44, 51, 52; 364/419.02, 419.03

[56] References Cited

U.S. PATENT DOCUMENTS

| | | | |
|---|---|---|---|
| 3,704,345 | 11/1972 | Coker et al. | 395/2.69 |
| 4,852,170 | 7/1989 | Bordeaux | 395/2.86 |
| 5,384,701 | 1/1995 | Stentiford et al. | 364/419.03 |
| 5,384,893 | 1/1995 | Hutchins | 395/2.67 |

FOREIGN PATENT DOCUMENTS

| | | | |
|---|---|---|---|
| 0095139 | 11/1983 | European Pat. Off. | G10L 1/10 |
| 0139419 | 5/1985 | European Pat. Off. | G10L 5/04 |
| 0327408 | 8/1989 | European Pat. Off. | G06F 3/16 |
| 57-89177 | 3/1982 | Japan | G06F 15/38 |

*Primary Examiner*—Kee Mei Tung
*Attorney, Agent, or Firm*—Oblon, Spivak, McClelland, Maier & Neustadt, P.C.

[57] ABSTRACT

An arrangement for improved speech comprehension in artificial translation of one language to a second language. The arrangement comprises an analysis unit which carries out an analysis of duration and fundamental tone of the speech in the first language. A prosody-interpreting unit determines, on the basis of the analysis and language-characteristic information, prosody-dependent information in the first speech which is used by a prosody-generating unit for the second language for controlling the speech synthesis. A speech synthesis element thus produces stresses in the speech translated in the second language which, from a language point of view, correspond to stresses in the first language.

2 Claims, 1 Drawing Sheet

ARRANGEMENT FOR INCREASING THE COMPREHENSION OF SPEECH WHEN TRANSLATING SPEECH FROM A FIRST LANGUAGE TO A SECOND LANGUAGE

FIELD OF THE INVENTION

The invention relates to an arrangement for increasing the comprehension of speech when translating speech from a first language to a second language. The invention is intended to be used in equipment which artificially tranlates speech in one language into verbal information in a second language. The aim of the invention is to achieve an improvement in the possibilities of creating a translation corresponding to the original speech by means of artificial translation.

PRIOR ART

Devices for speech synthesis and translation are already known. EP 327 408 and U.S. Pat No. 4,852,170 relate to systems for language translation. The systems comprise speech recognition and speech synthesis. However, the systems do not utilize prosody interpretation and prosody generation.

EP 0 095 139 and EP 0 139 419 describe speech synthesis arrangements which utilize prosody information. These documents, however, do not describe the utilization of prosody information in language translation.

One problem with the earlier technique is that it does not take stresses into account in translating from one language to another. The present invention solves the problem by using prosody-interpreting and prosody-generating units.

SUMMARY OF THE INVENTION

The present invention thus provides an arrangement for increasing the comprehension of speech when translating speech from a first language to a second language. The arrangement comprises elements for receiving speech in a first language, a translation unit for translating the speech in the first language to a second language, and speech synthesis elements for generating speech in the second language.

According to the invention, the arrangement also comprises an analysis unit which analyzes variations in the fundamental tone and duration of the speech in the first language, and a prosody-interpreting unit which determines first prosody-dependent information in dependence on the said analysis and on language-characteristic information which relates to the first language. A prosody-generating unit generates second prosody-dependent information with starting point from the first prosody-dependent information and from the language-characteristic information which relates to the second language. The second prosody-dependent information is used by the speech synthesis element for producing stresses in the second language corresponding to stresses in the speech in the first language.

Embodiments of the invention are specified in the subsequent Patent claims.

BRIEF DESCRIPTION OF THE DRAWING

The invention will now be described in detail with reference to the attached drawing, in which the single figure is a block diagram of a preferred embodiment of the invention.

DETAILED DESCRIPTION OF PREFERRED EMBODIMENTS

Figure 1:
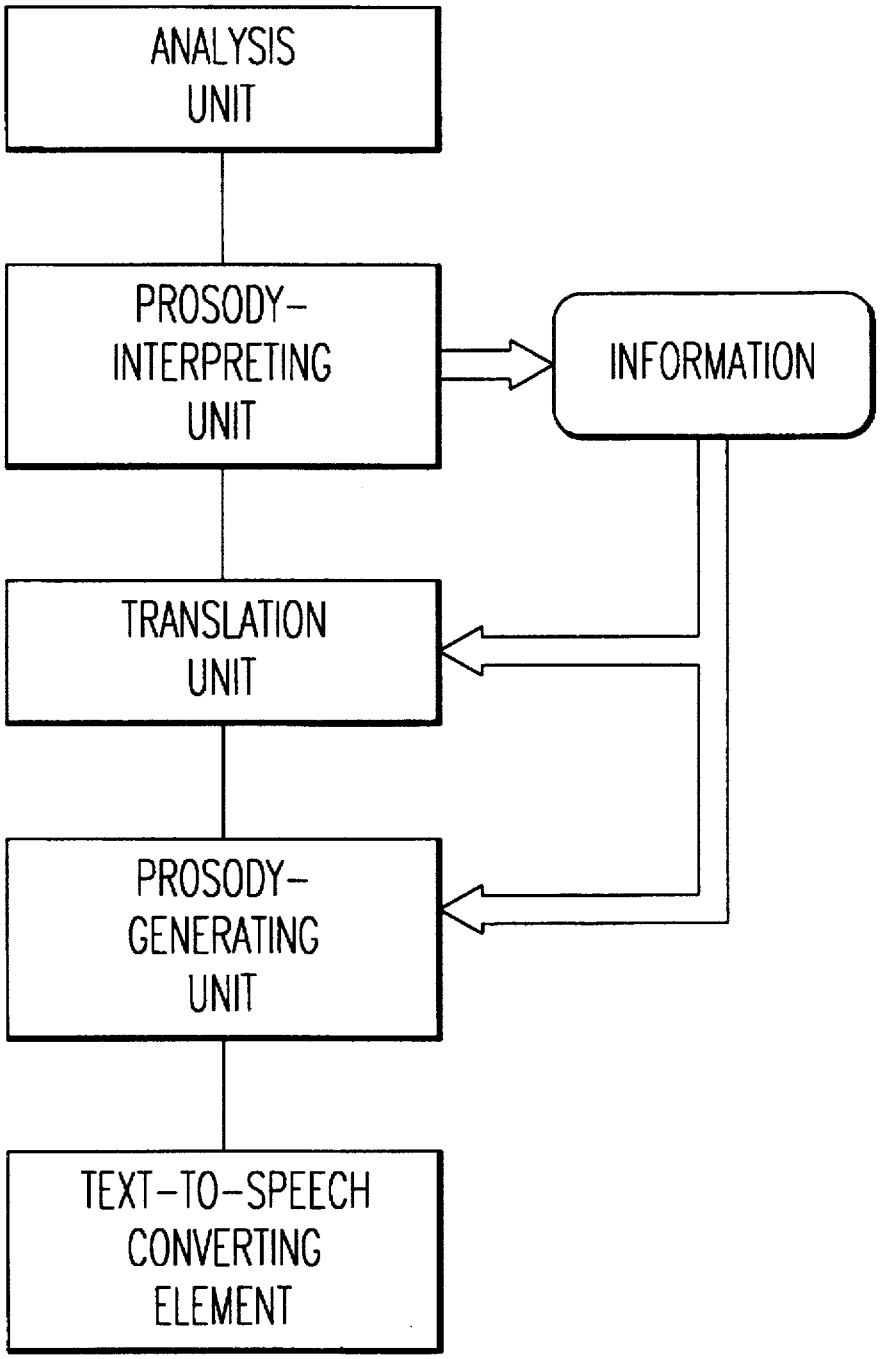

FIG. 1 shows a block diagram of an embodiment of the present invention. The arrangement produces a translation from speech in language 1 to speech in language 2. The arrangement comprises in known manner a speech recognition unit which preferably converts the received speech into text. A translation unit converts the text, also in a manner which is known per se, into text in a desired second language. The text in language 2 is converted into speech in a text/speech converting element.

The novelty in the present invention is, however, that the prosody, that is to say information on sound characteristics in sound combinations, in the input speech is utilized in the synthesis of the translated speech. The arrangement therefore comprises an analysis unit which carries out an analysis of the fundamental tone and duration of the sound combinations included in the speech. The analysis is supplied to a prosody-interpreting unit which assembles prosody-dependent information about the input speech, here called the first prosody-dependent information. This also utilizes information on language characteristics of the first language. These language characteristics are stored in advance in the prosody-interpreting unit.

The first prosody-dependent information is utilized by the translation unit but also by a prosody-generating unit which is characteristic of the present invention. The prosody-generating unit generates second prosody-dependent information which is supplied to the text-to-speech converting element. This element utilizes the second prosody-dependent information for producing stresses, that is to say fundamental tone and durations, which, from a language point of view, correspond to the stresses in the input speech in the first language. The translation, that is to say the speech in language 2, is thus given a prosody which corresponds to the prosody in the speech in language 1 which is to be translated. By this means, an enhanced comprehension of speech is achieved.

The scope of the invention is limited only by the Patent Claims below.

I claim:

1. Arrangement for increasing comprehension of speech when translating speech from a first language to a second language, comprising elements for receiving speech in a first language, a translation unit for translating speech in the first language to a second language, and speech synthesis elements for generating speech in the second language, characterized in that the arrangement also comprises an analysis unit which analyzes variations in fundamental tone and duration of the speech in the first language, a prosody-interpreting unit which determines first prosody-dependent information in dependence on said analysis unit and on language-characteristic information which relates to the first language, a prosody-generating unit which generates second prosody-dependent information with a starting point from the first prosody-dependent information and from language-characteristic information which relates to the second language, which second prosody-dependent information is used by the speech synthesis element for producing stresses in the second language corresponding to stresses in the speech in the first language.

2. Arrangement according to claim 1, characterized in that the receiving element comprises a speech recognition element which converts the first speech into text, the translation unit translating text in the first language into text in the second language, and in that the speech synthesis element comprises a text-to-speech converting element.

* * * * *